United States Patent [19]

Moench et al.

[11] 4,207,062

[45] Jun. 10, 1980

[54] HEATING AND MIXING APPARATUS FOR ASPHALTIC PAVEMENT

[76] Inventors: Frank F. Moench; Lawrence R. Moench, both of P.O. Box 6484, Albuquerque, N. Mex. 87107

[21] Appl. No.: 909,916

[22] Filed: May 26, 1978

[51] Int. Cl.[2] ..... F27B 3/06

[52] U.S. Cl. ..... 432/111; 366/25; 432/118

[58] Field of Search ..... 432/105, 111, 118, 119; 110/226, 246; 366/24, 25

[56] References Cited

U.S. PATENT DOCUMENTS

| | | | |
|---|---|---|---|
| 1,982,250 | 11/1934 | Hallenbeck | 432/111 X |
| 3,916,807 | 11/1975 | Eiki | 432/111 X |
| 4,039,171 | 8/1977 | Shearer | 366/25 |
| 4,143,972 | 3/1979 | Benson | 366/25 |

FOREIGN PATENT DOCUMENTS

| | | | |
|---|---|---|---|
| 1451511 | 9/1963 | Fed. Rep. of Germany | 110/246 |
| 2033535 | 7/1970 | Fed. Rep. of Germany | 110/246 |

*Primary Examiner*—Edward G. Favors
*Attorney, Agent, or Firm*—Ancel W. Lewis, Jr.

[57] ABSTRACT

Heating apparatus is disclosed that is particularly suited for use in combination with a drum mixer for treating asphalt aggregate materials to make such materials suitable for being applied to the ground surface. The heating apparatus generally comprises a plurality of flame-emitting gas burners and a combustion chamber for producing hot gases. A refractory lined plate assembly with an array of gas distributing ports is provided for spreading out hot gases discharged from the combustion chamber over the surface area of the plate assembly and also for inhibiting the open flames from passing from the combustion chamber. The combustion chamber is constructed to withstand the impacts and high temperatures encountered during operation of the mixer, as during transport, by attaching refractory bricks with metal backing plates to a rigid framework. The plate assembly is constructed in sections that are movable relative to one another to permit expansion and contraction with temperature variations. In the combination the heating apparatus and drum mixer are mounted end-to-end in coaxial alinement and on a vehicle for vehicular movement with the plate assembly between the combustion chamber and the interior of the drum and with the heating apparatus stationary relative to the rotational movement of the drum.

23 Claims, 10 Drawing Figures

HEATING AND MIXING APPARATUS FOR ASPHALTIC PAVEMENT

FIELD OF THE INVENTION

This invention relates generally to apparatus for heating and mixing materials and more particularly to new and improved heating apparatus and the combination thereof with a drum mixer adapted for use on a vehicular assembly for mixing and heating asphalt aggregate materials during vehicular movement thereof.

BACKGROUND OF THE INVENTION

In the construction of roads and highways large drum mixers are often utilized to mix and heat asphalt aggregate mixtures for preparing the materials for application as a pavement. In addition, these drum mixers are often utilized in reconditioning applications where materials are removed from an existing roadway, heated and mixed with a conditioner, and then used to repave the roadway.

In the past, most of the drum mixers used for this purpose have been stationary installations requiring the materials to be transported to and from the installation. As pointed out in my copending application Ser. No. 747,295 entitled "Asphaltic Pavement Treating Apparatus and Method," there are numerous advantages in having the apparatus moved over the surface in a vehicular movement during which the materials are treated on a continuous basis. In that application there is shown a form of combination drum mixer and heating apparatus that is operated during vehicular movement wherein one or more burners emit an open flame for producing the hot gases. When an open flame is utilized, it is desirable to prevent the materials from directly contacting the flame, which because of its high temperature may cause the asphalt to flash and smoke, emitting pollutants into the atmosphere. In addition, it is also desirable to effect a uniform temperature distribution throughout the drum to prevent localized hot spots and uneven heating, which can also cause overheating and flashing of the asphalt.

For this reason in some drum mixers, such as the mixer disclosed in U.S. Pat. No. 3,845,941 to Mendenhall, the materials are tumbled over heated pipes which prevent direct exposure of the material to the flames and hot gases produced by the heating apparatus. Alternately, baffle plates or flame barriers, such as the barriers disclosed in U.S. Pat. No. 3,999,743 to Mendenhall, and in U.S. Pat. No. 4,039,171 to Shearer, may be mounted between the open flame and the interior of the drum to help prevent the material from directly contacting the open flame and to aid in the distribution of gases from the heating apparatus into the mixing drum.

Some of the problems with these prior art drum mixers is that the heating apparatus and flame barriers do not effectively distribute the hot gases through the mixing drum and/or are not sturdy enough to withstand the temperatures and the vibrations, jarring and impacts encountered during usage and transport as the apparatus is moved forwardly over the road or like supporting surface. In addition, some prior art flame barriers must be fabricated from expensive metals and materials in order to avoid warping and withstand the high temperatures present in the drum mixers.

Accordingly, it is an object of the present invention to provide simple, durable and relatively inexpensive heating apparatus for use in combination with drum mixers for producing hot gases and for uniformly distributing the gases into the drum mixer for heating materials.

Another object of the present invention is to provide heating apparatus for use in combination with drum mixers wherein an open flame is utilized for producing hot gases and the material to be heated is shielded from the open flame.

Yet another object of the present invention is to provide heating apparatus for use in combination with drum mixers, having a refractory lined combustion chamber and gas distributor plate constructed to withstand the impacts and high temperatures encountered in a drum mixer.

SUMMARY OF THE INVENTION

Heating apparatus and a combination thereof with a drum mixer for treating asphalt aggregate material or the like. The heating apparatus generally comprises a plurality of flame emitting gas burners for producing hot gases and a refractory lined combustion chamber with a refractory lined plate assembly located between the combustion chamber and mixing drum with an array of ports for distributing the hot gases from the combustion chamber into the mixing drum. The combustion chamber is mounted at the discharge end of the mixing drum and is constructed by attaching refractory bricks with metal backing plates to a rigid framework. In addition, the gas burners are attached to the framework for emitting open flames into the combustion chamber for producing the hot gases. The hot gases produced in the combustion chamber are drawn by a fan or by natural circulation from the combustion chamber through the gas distributor plate assembly into the mixing drum. The plate assembly is generally circular in shape and the spaced ports are arranged in a radially and circumferentially spaced pattern over all quadrants of a 360-degree circle for uniformly radially dispersing and distributing the hot gases into a plurality of substantially evenly spaced streams as the gases are drawn into the mixing drum. The plate assembly is constructed by casting refractory material on either side of four metal backing plates fixed to the framework but free to move relative to one another to permit the gas distributor plate to expand and contact with temperature variations. The gas distributor plate assembly also functions to prevent the open flames from contacting the asphalt aggregate material.

Other objects, advantages and capabilities of the present invention will become more apparent as the description proceeds, taken in conjunction with the accompanying drawings in which like parts have similar reference numerals and in which.

DESCRIPTION OF THE PREFERRED EMBODIMENTS

Figures 1, 2, 7:
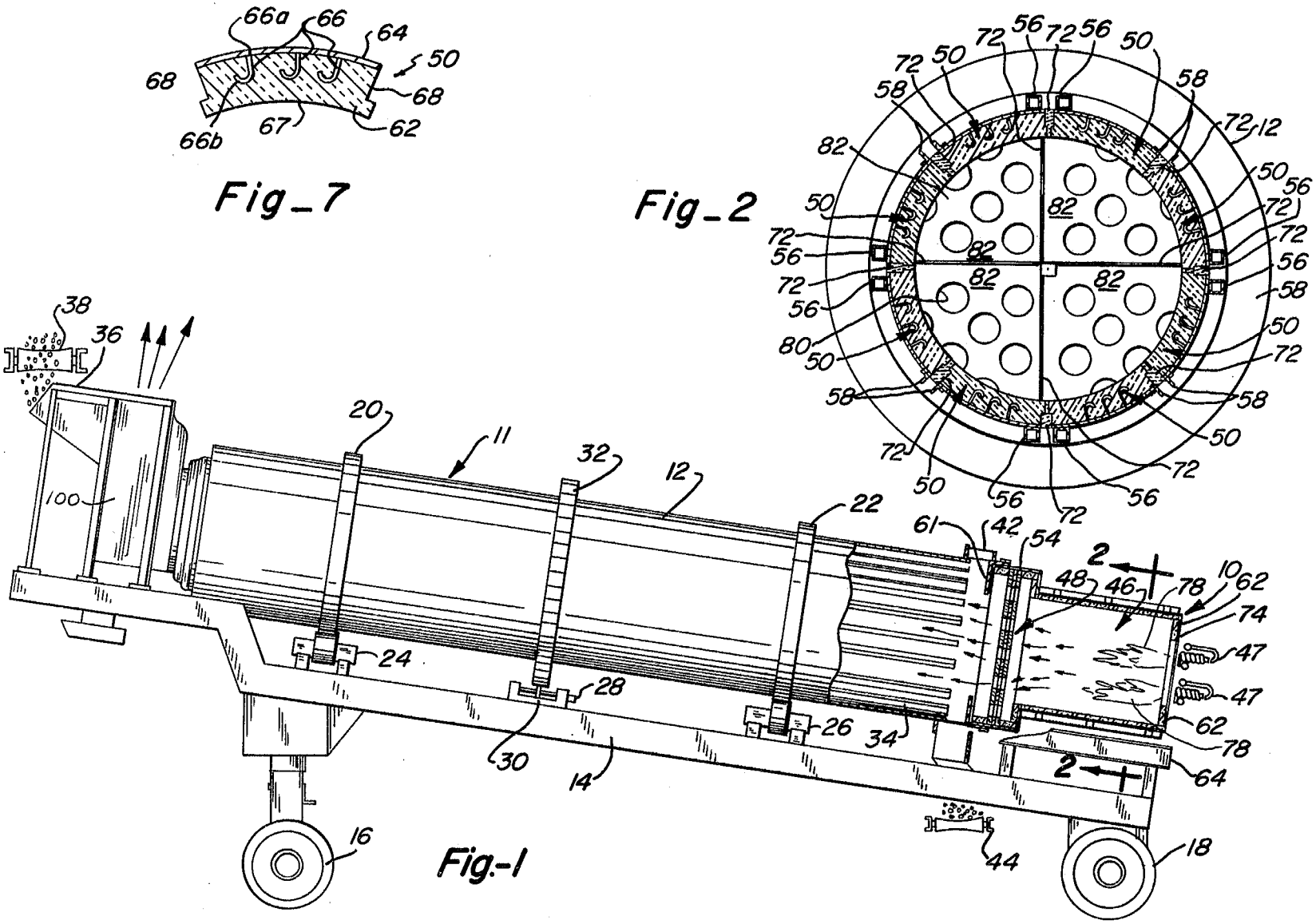
FIG. 1 is a side elevation view partly cut away of a combination heating and mixer apparatus of the present invention.
FIG. 2 is an enlarged cross-sectional view along section line 2—2 of FIG. 1 showing a cross section of the combustion chamber and gas distributor plate assembly of the invention.
FIG. 7 is a cross-sectional view of a refractory brick of the invention.

Referring now to FIG. 1, the heating apparatus shown is generally designated 10. The heating apparatus 10 is shown in combination with a drum mixer 11 that is suitable for treating asphalt aggregate material. Drum mixer 11 shown generally comprises a hollow cylindrical mixing drum 12 rotatably mounted on a trailer frame 14 for tumbling and mixing the asphalt aggregate materials during vehicular movement and has an inlet opening for receiving untreated materials and outlet openings for discharging the treated materials. The trailer frame 14 is supported on sets of front wheels 16 and rear wheels 18 for towing by a truck.

The mixing drum 12 is mounted on the trailer frame 14 for rotation about its longitudinal axis and is supported on an external front bearing band 20 and an external rear bearing band 22 which are rotatably mounted on bearings 24 and 26, respectively, on the trailer frame 14. The mixing drum 12 may be rotated by an electric motor 28 through a drive gear 30 that meshes with an external ring gear 32 affixed to the periphery of the drum. The trailer frame 14 is inclined to support the drum 12 with a slightly downward incline from front to rear for gravity-feeding asphalt aggregate materials through the drum from the inlet to the outlet thereof. As shown in FIG. 1, this angle for the drum is approximately 9 degrees to the horizontal.

A plurality of lifting and tumbling flights 34 are attached to the interior wall of the mixing drum 12 and extend from end to end therealong. As the mixing drum 12 is rotated about its longitudinal axis, tumbling flights 34 tumble and mix the asphalt aggregate materials that move by gravity through the mixing drum 12.

An inlet hopper 36 is mounted on the trailer frame 14 at the inlet portion of the mixing drum 12 for feeding asphalt aggregate material from an inlet conveyor 38 or the like through a central inlet opening of the mixing drum into the interior of the drum. Inlet hopper 36 is stationary with respect to the rotatable mixing drum 12. A plurality of outlet openings 40 (FIG. 3) are located at the discharge end of the mixing drum 12 circumferentially spaced along the periphery of the drum 12. A discharge casing or shroud 42 (FIG. 1) surrounds the rear end of the mixing drum 12 and encompasses these discharge openings 40. Discharge casing 42 is fixedly mounted with respect to the drum 12 on the trailer frame 14 and has downwardly converging wall portions that form a chute to direct the material discharged from the discharge openings 40 onto a discharge conveyor 44 or the like.

The heating apparatus 10 is also supported for vehicular movement by frame 14 and is provided for heating the materials within the drum. Heating apparatus 10 generally stated includes a combustion chamber 46 and a plurality of gas burners 47 for producing hot gases. Structural means in the form of a plate assembly 48 with gas distributing ports 80 is mounted between the interior of the combustion chamber 46 and the interior of the drum to direct and distribute hot gases from the combustion chamber 46 into the interior of the drum 12.

Figure 3:
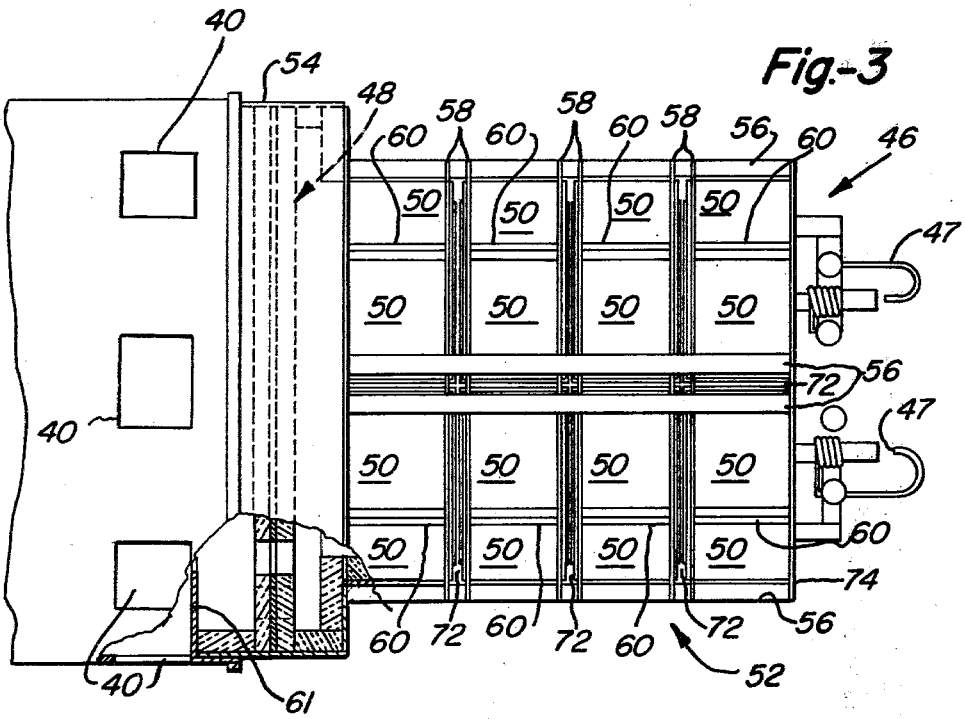
FIG. 3 is an enlarged elevation view, partly cut away with parts removed, of the combustion chamber and gas burners of the present invention.

Referring now to FIG. 2, the construction of the combustion chamber 46 is shown. The combustion chamber 46 is generally cylindrical in shape and is constructed using a plurality of refractory bricks 50 welded to a rigid framework 52 (FIG. 3) fixedly mounted on the trailer frame 14 adjacent to the discharge end of the drum 12. As shown in FIG. 3, framework 52 comprises a generally cylindrical support shroud 54, eight tubular support members 56, six annular support plates 58, and thirty-two right-angle strut members 60. Support shroud 54 has an outside diameter slightly smaller than the inside diameter of the rear end portion of the mixing drum 12 and, as shown in FIG. 3, is fixedly supported with an end portion extending into the interior of the end portion of drum 12 concentric with or coaxially alined with the drum with the drum free to rotate around the shroud 54. An annular ring 61 is attached to the interior surface of the drum 12 adjacent to but spaced from the support shroud 54 to prevent hot gases from escaping through the clearance space between the rotatable drum 12 and fixed support shroud 54. This construction facilitates the ready installation and use of the heating apparatus 10 with a number of different types of commercially available drum mixers.

To form the framework the tubular support members 56 are welded to the support shroud 54 parallel to the longitudinal axis of the combustion chamber 46. Annular support plates 58 are welded to the tubular support members 56 in planes perpendicular to the longitudinal axis of the combustion chamber 46, and angle strut members 60 are welded between the annular support plates 58 to rigidify the framework. The framework 52 is fixedly supported by channel members 63, 64, 65 (FIG. 10) attached to the trailer frame 14 to support the combustion chamber 46 adjacent to the discharge end of the drum for discharging hot gases into the interior of the drum.

To enclose the framework 52 and form the combustion chamber 46 the refractory bricks 50 are welded to the framework 52 along the periphery of the framework. As shown in FIG. 7, refractory bricks 50 are constructed by casting refractory material 62 capable of withstanding high temperatures without warpage or shrinkage, onto a curved metal backing plate 64. The refractory material used may be similar to the refractory material utilized for lining gas furnaces or the like. A plurality of fasteners 66 are welded to the backing plate and enbedded in the refractory material before it is fired and have flat end portions 66*a* which are welded to the backing plate 64 and hook end portions 66*b* which are embedded in the refractory material 62. Each refractory brick 50 has a curved interior surface 67 which matches the curvature of the backing plate 64 and stepped side edge surfaces 68. This construction forms a strong rigid brick capable of withstanding the shocks and impacts encountered in a mixer.

When the refractory bricks 50 are welded or similarly attached to the framework 52, the spaces between the refractory bricks 50 are filled with insulating wool 72 (FIG. 2) for sealing the combustion chamber 46 and for providing expansion joints between adjacent refractory bricks 50. The stepped side edge 68 construction of the refractory bricks 50 permits the insulating wool 72 to be easily packed between the bricks. The insulating wool 72 may be of the aluminum silicate type such as the product of Carborundum Corporation sold under the trademark "Fibre-frax."

Figure 10:
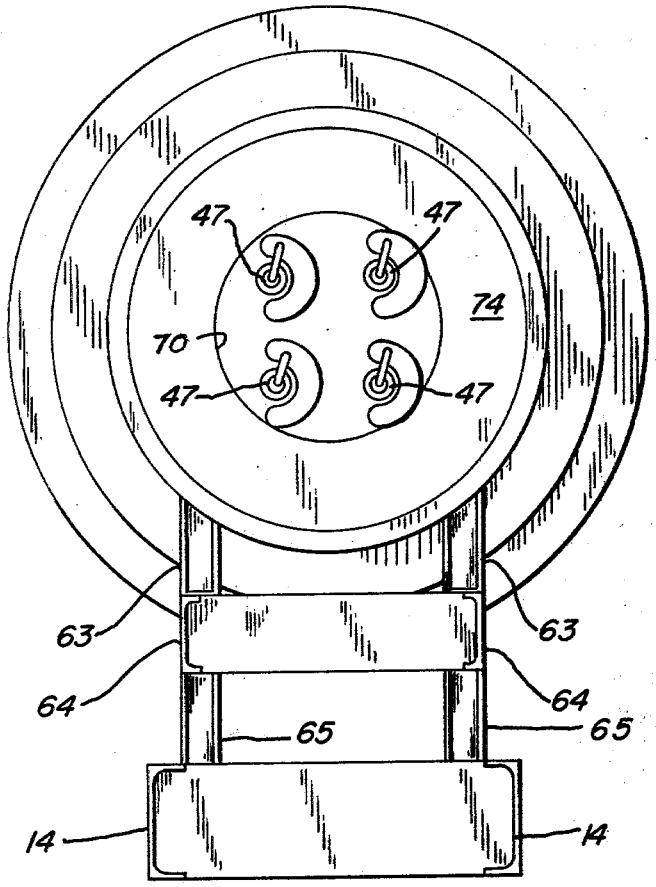
FIG. 10 is a rear view of FIG. 1.

The combustion chamber 46 has an end wall 74 (FIG. 1) welded to the framework 52 for mounting the gas burner assemblies 47 for directing open flames 78 into the interior of the combustion chamber 46 via an end opening 70 for producing the hot gases. As shown in FIG. 10, there are four gas burner assemblies 47 mounted to the end wall 74 at circumferentially spaced equal distances from each other in a generally square pattern with one burner located in each quadrant of a 360-degree span. The gas burner assemblies 47 may be of the type further described in my prior U.S. Pat. No. 3,840,321 and typically emit a very high temperature open flame 78 for producing hot gases in the combustion chamber 46. Refractory material 62 (FIG. 1) may be cast to the end wall 74 circumjacent to the burner assemblies 47 and attached to the end wall 74 with fasteners 66 in the same manner that the refractory bricks 50 previously described are constructed.

The plate assembly 48 is mounted to the support shroud 54 concentric to or coaxially alined with the combustion chamber 46 and perpendicular to the longitudinal axis of the mixing drum 12 and is located between the interior of the combustion chamber 46 and interior of the mixing drum 12 downstream from the open flames 78 produced by the burner assemblies 47.

Figure 6:
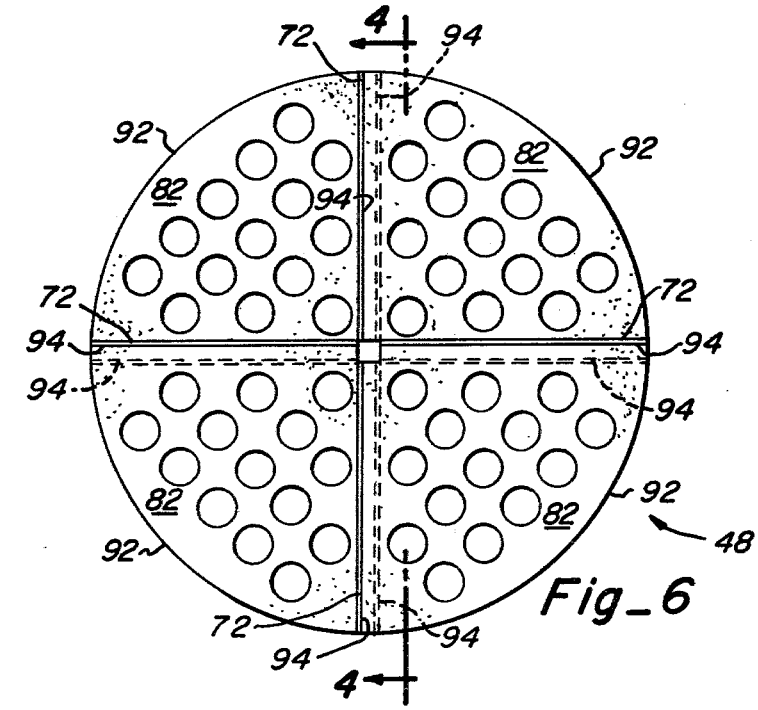
FIG. 6 is a plan view of FIG. 5.
Figure 5:
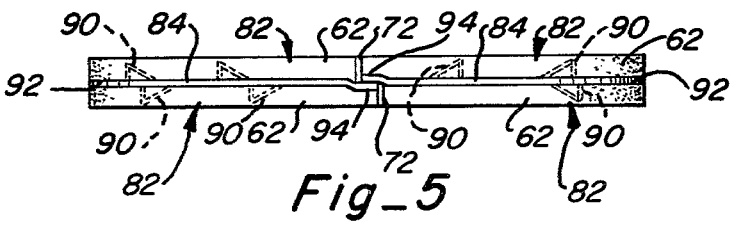
FIG. 5 is a side elevation view of the gas distributor plate assembly of the invention.
Figure 4:
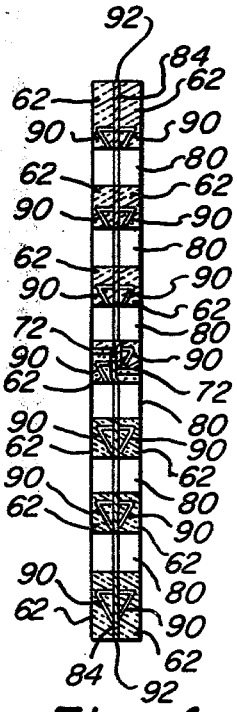
FIG. 4 is an enlarged cross-sectional view taken along section line 4—4 of the gas distributor plate assembly of the invention.

As shown in FIGS. 4, 5 and 6, plate assembly 48 has a generally circular peripheral configuration with an outside diameter approximately equal to the inside diameter of the mixing drum 12 and has an array of spaced apertures or ports 80 that extend through the thickness of the plate assembly 48. The gases are drawn from the combustion chamber 46 into the mixing drum 12 by a fan 100 located at the inlet end of the mixing drum 12. In some applications a fan is not required to circulate the hot gases.

The ports 80 may be spaced in a variety of uniform arrays or patterns which will distribute the hot gases into a plurality of radially uniformly spaced streams as the hot gases are drawn through the distributor plate 48. The positioning of the ports 80 is generally similar in each quadrant of a span of 360 degrees and this positioning is characterized as equal spacing in a radial direction for uniformly radially dispersing the heated gases into the drum mixer. In addition, the gas distributor plate 48 functions as a flame barrier to prevent the open flames 78 from extending out of the combustion chamber 46 into the interior of the drum 12 and contacting the asphalt aggregate material.

Figure 8:
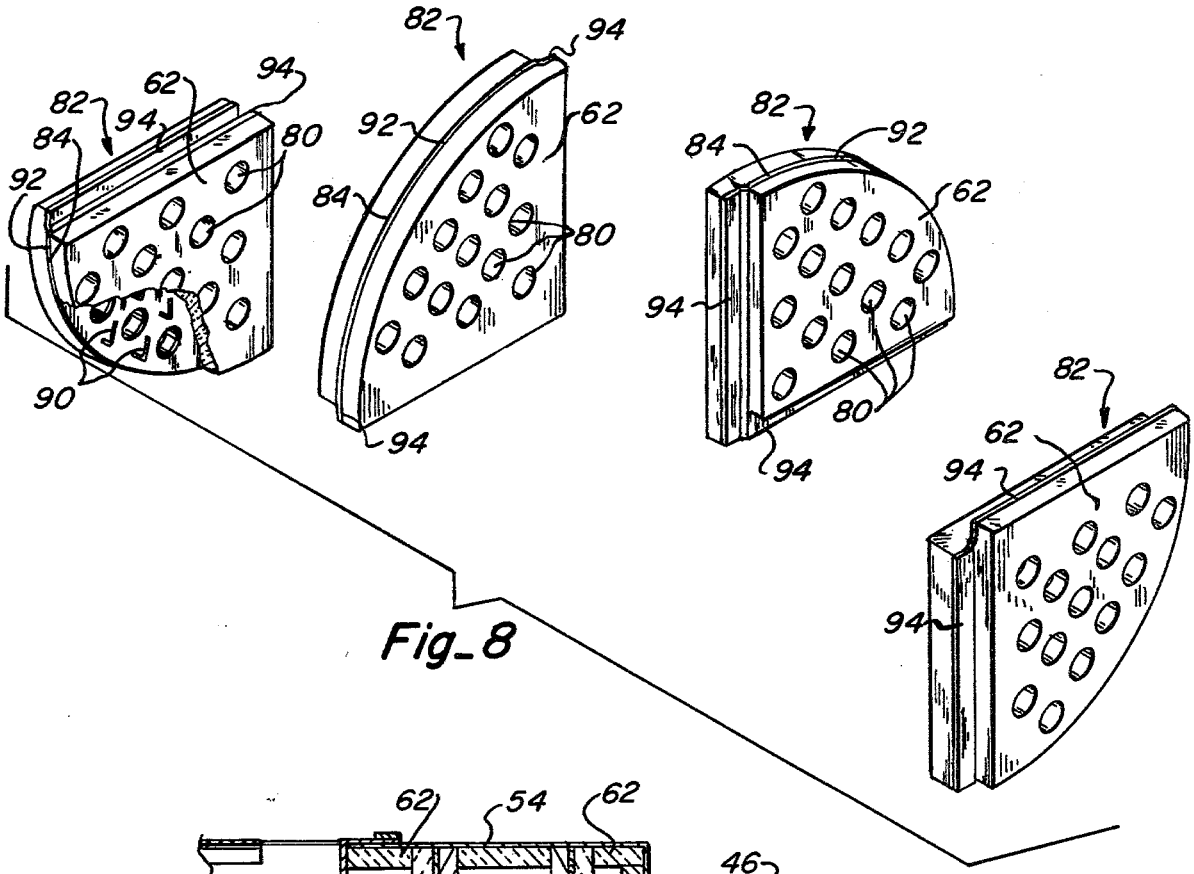
FIG. 8 is an assembly perspective view showing the construction of the gas distributor plate.

Referring now to FIG. 8, the construction of the plate assembly 48 is shown. The plate assembly 48 is constructed from four sections 82 each having a generally pie-shaped peripheral configuratin with an arcuate outside edge 92 and two straight inside edges 94. Each pie-shaped section includes a metal support plate 84 having refractory material 62 cast and affixed to fasteners 90 on each side or on opposite faces thereof to provide a double thickness of refractory material. The fasteners 90 are metal and of a generally V-shaped configuration and are welded on both ends to a slide of the support plate 84 and embedded in the refractory material 92 prior to firing to hold the refractory material onto the support plate 84.

Each support plate 84 has a plurality of the spaced ports 80 arranged in a similar array or pattern and the refractory material 62 is cast to the support plates 84 such that the ports are left unobstructed. The straight inside edges 94 of the support plates 84 are stepped so that the support plates may be lapped over one another, as shown in FIG. 5, for constructing the gas distributor plate.

For assembling the circular gas distributor plate 48, each pie-shaped support plate 84 is attached along its outside arcuate edge 92 to the support shroud 54 (FIG. 1). The inside straight stepped edges 94 of each support plate are left unattached and mate with the stepped inside straight edge 94 on an adjacent support plate permitting the plates to be lapped as shown. This lapped construction allows the support plates 84 to move relative to one another permitting the gas distributor plate to expand and contract with temperature differentials. When casting the refractory material 62 onto the pie-shaped support plates 84, spaces are left between adjacent plates and packed with insulating wool 72, as previously explained, to form expansion joints.

One effective method of constructing the gas distributor plate 84 is to first affix the metal fasteners 90 to both sides of the four pie-shaped support plates 84 and cast refractory material on only one side of the support plates 84. The support plates 84 can then be attached along their outside arcuate edges 92 to the support shroud 54 and the plates lapped along their inside edge to form the completed circular structure. Insulating wool 72 can then be packed between the pie-shaped sections 82 on the cast refractory side. On the opposite side of the support plates 84 wood strips can be attached to the support plates 84 in the spots between adjacent support plates 84 where expansion joints are desired and the refractory material can be cast over the entire side. When the refractory material is fired the wood strips will burn off and insulating wool 72 can be packed in the resultant space for forming the expansion joints.

As shown in FIG. 1, the gas distributor plate is attached to the inside diameter of the support shroud 54 in coaxial alinement with the axis of the combustion chamber 46 and prevents the open flames 78 of the burner assemblies 47 from contacting the asphalt aggregate material in the interior of the mixing drum 12 and directs the hot gases formed in the combustion chamber through its ports 80 for uniformly distributing the hot gases. Additional refractory material 62 is attached to the inside walls of the support shroud 54 on either side of the gas distributor plate 48 in the manner previously described.

Alternately the gas distributor plate 48 may be fabricated with refractory material 62 attached to only one side and mounted with the refractory material facing the open flames.

OPERATION

In operation the gas burners 47 are fired for producing open flames 78 in the combustion chamber 46. The burning flames heat the air present in combustion chamber 46 and product hot gases which are drawn by a fan 100 or through natural circulation through the ports 80 of the gas distributor plate 48, into the interior of the drum 12 for heating the materials present in the drum. The hot gases are then drawn out through the inlet hopper 36 to the atmosphere. The direction of hot gas flow is indicated by arrows in FIG. 1.

The plate assembly 48 protects the asphalt aggregate material from contacting the open flames 78 in the combustion chamber 70. The spaced ports 80 of the plate assembly are located in the direction of flow of the hot gas stream and radially disperse and uniformly direct the hot gases from the combustion chamber 46 into the interior of the drum 12 so that a substantially uniform radial temperature distribution is maintained throughout the drum for uniformly heating the material. The ports 80 function to uniformly distribute the hot gases by channeling the unitary gas stream produced by the gas burners into a plurality of smaller evenly spaced gas streams. Because the plate assembly has a diameter approximately equal to the inside diameter of the mixing drum, the hot gas streams are distributed uniformly substantially throughout the entire cross section of the mixing drum.

Figure 9:
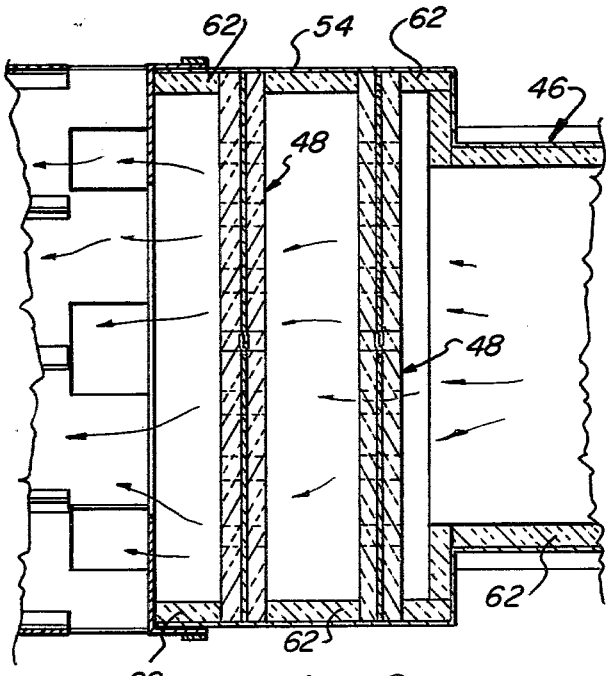
FIG. 9 is a side elevation view of an arrangement utilizing two spaced gas distributor plate assemblies.

In an alternate embodiment of the invention shown in FIG. 9, two spaced gas distributor plates 48 may be mounted within the support shroud 54 between the combustion chamber 46 and the interior of the mixing drum 12. The two gas distributor plates 48 may be spaced apart a distance of approximately one foot for providing extra protection from the open flames and additional spaced ports 80 for distributing the hot gases.

In both embodiments the combustion chamber 46 and gas distributor plate 48 function effectively to produce and distribute hot gases throughout the mixing drum. The rigid framework and construction enable the combustion chamber to stand up against the vibrations, shocks, and impacts encountered during vehicular movement and in association with a drum mixer. In addition, the refractory brick and expansion joint construction of the combustion chamber is able to withstand the high temperatures and temperature gradients that occur. The refractor lines plate assembly 48 is also able to withstand shocks and impacts and high temperatures, and the lapped sectional construction of the plate assembly allows it to expand and contract with temperature gradients.

Although the present invention has been described with a certain degree of particularity, it is understood that the present disclosure has been made by way of example and that changes in details of structure may be made without departing from the spirit thereof.

What is claimed is:

1. Heating apparatus for use in combination with a drum mixer suitable for mixing asphalt aggregate materials and the like, said heating apparatus comprising:

a heat source; and a combustion chamber in which hot gases are produced by heat from said heat source, said combustion chamber having structural means including a layer of refractory material cast on a metal support plate and on a plurality of fasteners attached to said support plate with an array of gas distributing ports through which hot gases in the combustion chamber are discharged whereby to direct a plurality of streams of hot gases into a drum mixer to heat materials being mixed therein.

2. Heating apparatus as defined in claim 1 wherein said structural means is in the form of a plate assembly fabricated in a plurality of sections free to move relative to one another for expansion and contraction with temperature variations.

3. Heating apparatus as defined in claim 2 wherein said plate assembly has a generally circular peripheral configuration and said ports are disposed at substantially evenly radially spaced intervals over substantially the entire transverse cross-sectional area of said shape for directing the hot gases in a plurality of substantially radially evenly spaced and circumferentially spaced streams in a longitudinal direction into the interior of the drum mixer.

4. Heating apparatus as set forth in claim 2 wherein said plate assembly has a layer of refractory material on opposite faces of each support plate to provide a double thickness of refractory material.

5. Heating apparatus as defined in claim 1 wherein said structural means is fabricated from a plurality of support plates attached together along an outer edge portion with the remainder of each support plate free to move relative to an adjacent support plate for allowing said structural means to expand and contract with temperature variations.

6. Heating apparatus as defined in claim 1 wherein said heat source includes at least one burner emitting an open flame into the combustion chamber for producing hot gases.

7. Heating apparatus as defined in claim 5 wherein said structural means inhibits said open flames from passing from said combustion chamber via said ports.

8. Heating apparatus as defined in claim 1 wherein said combustion chamber has an inner lining of refractory material.

9. Heating apparatus as defined in claim 8 wherein the refractory lined combustion chamber is fabricated by attaching a plurality of refractory bricks to a rigid outer framework.

10. Heating apparatus as defined in claim 9 wherein the refractory bricks have expansion joints therebetween.

11. Heating apparatus as defined in claim 1 wherein said combustion chamber is of a generally cylindrical configuration with said heat source located at one end and said structural means located at the opposite end.

12. Heating apparatus as defined in claim 8 wherein an end portion of said combustion chamber is sized to insert into an end portion of a rotatable drum mixer in coaxial alinement therewith to discharge the hot gases into the interior of said drum mixer.

13. Heating apparatus as defined in claim 1 wherein said heat source includes four burners located at circumferentially spaced intervals with one burner located in each quadrant of a 360-degree span.

14. Heating apparatus for use in combination with a drum mixer for mixing and treating asphalt aggregate materials and the like, said heating apparatus comprising:

a frame adapted to be mounted adjacent to an opening into the interior of a drum mixer;

a plurality of refractory bricks attached to the frame to form a combustion chamber with an inside diameter adapted to be in communication with the opening of the mixing drum;

at least one burner assembly for emitting open flames into the combustion chamber for producing hot gases in said combustion chamber; and a plate assembly opposite said burner assembly having a transverse cross-sectional area substantially equal to the inside diameter of the combustion chamber with refractory material cast on at least one side facing the open flames and having an array of spaced ports for directing the hot gases produced in the combustion chamber into the mixing drum in a plurality of substantially radially evenly spaced gas streams for substantially uniformly heating the asphalt aggregate material.

15. Heating apparatus as defined in claim 14 wherein said plate assembly is fabricated by attaching a plurality of metal support plates with refractory material attached thereto to said frame along a single outside peripheral edge with the support plates free to move relative to one another for expansion and contraction.

16. Heating apparatus as defined in claim 15 wherein said metal support plates are generally pie-shaped and attached together along their outside arcuate edges with the inside edges of the support plates unattached and lapped over one another.

17. Heating apparatus as defined in claim 14 wherein said refractory bricks are fabricated by casting refractory material onto metal backing plates and fasteners.

18. Heating apparatus as defined in claim 17 wherein the refractory bricks are attached to the frame with spaces therebetween and the spaces are filled with insulating material forming expansion joints.

19. Apparatus as defined in claim 2 wherein two plate assemblies are mounted parallel to each other and spaced apart.

20. In apparatus for mixing and heating asphalt aggregate materials and the like including a drum mixer mounted for rotation about its longitudinal axis for mixing the materials and heating apparatus adjacent the mixing drum including at least one burner producing an open flame, said heating apparatus being arranged for directing heated gas into the mixing drum for heating the material being mixed therein, the improvement comprising:

structural means mounted between the heating apparatus and drum mixer and having a layer of refractory material cast on a metal support plate and on a plurality of fasteners attached to said support plate with an array of spaced ports for separating hot gases produced in the heating apparatus into a plurality of spaced gas streams for distribution into the mixing drum for evenly heating the material and also for shielding the material from any open flames utilized in the heating apparatus.

21. A combination mixing drum and heating apparatus for asphalt aggregate materials comprising:

a drum mixer having a mixing drum rotatable about its longitudinal axis;

gas producing means for producing a stream of hot gases for discharge into the mixing drum; and structural means including a plate assembly mounted substantially perpendicular to the longitudinal axis of the mixing drum and having an area substantially equal to an inside diameter of the mixing drum and a layer of refractory material cast on a metal support plate and on a plurality of fasteners attached to said support plate with a plurality of spaced ports for directing the streams of hot gases into a plurality of substantially radially evenly spaced gas streams into said mixing drum for uniformly heating the asphalt aggregate material.

22. A combination mixing drum and heating apparatus as set forth in claim 21 wherein said plate assembly has a plurality of pie-shaped metal support plates with each plate attached along an arcuate outside edge to the frame to form a unitary circular structure of an outside diameter approximately equal to an inside diameter of the combustion chamber and with refractory material attached to both sides of each support plate and with each plate having a plurality of spaced ports for directing the stream of hot gases from the combustion chamber to the mixing drum in a plurality of evenly radially spaced streams for uniformly heating the material within the mixing drum.

23. In portable apparatus for mixing and heating asphalt aggregate materials and the like on a continuous base during vehicular movement over the ground surface, the combination comprising:

vehicle means adapted for vehicular movement;

a drum mixer on said vehicle means having a mixing drum mounted for rotation about its longitudinal axis;

heating apparatus fixedly mounted on said vehicle means supported at a stationary position relative to the rotation of said drum, said heating apparatus having structural means including a layer of refractory material cast on a metal support plate and on a plurality of fasteners attached to said support plate with an array of gas distributing ports through which hot gases in the combustion chamber are discharged whereby to direct a plurality of streams of hot gases into a drum mixer to heat materials being mixed therein; and blower means on said vehicle means to draw a stream of heated gases produced by said heating apparatus through said structural means and into said mixing drum for heating the asphalt aggregate material therein.

* * * * *